US008845184B2

(12) United States Patent
Cusin et al.

(10) Patent No.: US 8,845,184 B2
(45) Date of Patent: Sep. 30, 2014

(54) ASSEMBLY DEVICE USING THE DEFORMATION OF RESILIENT ARMS

(71) Applicant: Nivarox-FAR S.A., Le Locle (CH)

(72) Inventors: Pierre Cusin, Villars-Burquin (CH); Marc Stranczl, Nyon (CH); Daniel Mallet, Le Belieu (FR); Emmanuel Graf, Le Locle (CH)

(73) Assignee: Nivarox-FAR S.A., le Locle (CH)

( * ) Notice: Subject to any disclaimer, the term of this patent is extended or adjusted under 35 U.S.C. 154(b) by 0 days.

(21) Appl. No.: 14/098,740

(22) Filed: Dec. 6, 2013

(65) Prior Publication Data

US 2014/0160901 A1 Jun. 12, 2014

(30) Foreign Application Priority Data

Dec. 11, 2012 (EP) ..... 12196577

(51) Int. Cl.

| | |
|---|---|
| ***G04B 15/00*** | (2006.01) |
| ***G04B 17/04*** | (2006.01) |
| ***G04B 15/14*** | (2006.01) |
| ***G04D 3/00*** | (2006.01) |

(52) U.S. Cl.

CPC ..... *G04D 3/0028* (2013.01); *G04B 15/14* (2013.01)

USPC ..... 368/124; 368/127; 368/177; 368/324

(58) Field of Classification Search

USPC ..... 368/124, 127, 177, 324–326; 74/126

See application file for complete search history.

(56) References Cited

U.S. PATENT DOCUMENTS

| | | | | |
|---|---|---|---|---|
| 3,849,011 | A * | 11/1974 | Berthoud | 403/165 |
| 3,922,041 | A * | 11/1975 | Quaile et al. | 368/324 |
| 4,358,166 | A * | 11/1982 | Antoine | 384/215 |
| 8,707,536 | B2 * | 4/2014 | Verardo et al. | 29/522.1 |
| 2011/0005055 | A1 | 1/2011 | Gigandet et al. | |
| 2012/0090933 | A1 | 4/2012 | Conus et al. | |
| 2012/0186054 | A1 * | 7/2012 | Cusin et al. | 29/225 |

FOREIGN PATENT DOCUMENTS

| | | | |
|---|---|---|---|
| CH | 704 386 | A2 | 7/2012 |
| EP | 1 850 193 | A1 | 10/2007 |
| EP | 2 273 322 | A1 | 1/2011 |
| EP | 2 442 189 | A1 | 4/2012 |

OTHER PUBLICATIONS

European Search Report issued Jul. 10, 2013 in European Application 12196577, filed on Dec. 11, 2012 ( with English Translation).

* cited by examiner

*Primary Examiner* — Vit W Miska

(74) *Attorney, Agent, or Firm* — Oblon, Spivak, McClelland, Maier & Neustadt, L.L.P.

(57) ABSTRACT

The invention relates to a system of assembling a member, made of a first material, in the aperture of a part made of a second material having no usable plastic domain, using an intermediate portion (7, 27, 47, 67, 87) made of a third material, mounted between said member and said part. According to the invention, the part is accommodated against a first level (6) of the intermediate portion and is resiliently locked on a second level of the intermediate portion by the member in order to secure together the unit comprising the member—intermediate portion—part.

The invention concerns the field of timepieces.

15 Claims, 3 Drawing Sheets

ASSEMBLY DEVICE USING THE DEFORMATION OF RESILIENT ARMS

This application claims priority from European Patent Application No. 12196577.6 filed on Dec. 11, 2012, the entire disclosure of which is hereby enclosed herein by reference.

FIELD OF THE INVENTION

The invention relates to a system of assembling a part, made of a material having no usable plastic domain (i.e. very limited plastic domain), to a member comprising a different type of material.

BACKGROUND OF THE INVENTION

Current assemblies including a silicon-based part are generally secured by bonding. This type of operation requires extremely delicate application which makes it expensive.

EP Patent No. 1 850 193 discloses a first, silicon-based part which is assembled on a metal arbour using an intermediate metallic part. However, the shape variants proposed in this document are not satisfactory and either cause the silicon part to break during the assembly thereof, or do not bind the parts sufficiently well to each other.

SUMMARY OF THE INVENTION

It is an object of the present invention to overcome all or part of the aforecited drawbacks by providing an adhesive-free assembly which can secure a part made of a material with no usable plastic domain to a member comprising a ductile material, such as, for example, a metal or metal alloy.

The invention therefore relates to a system of assembling a member made of a first material in the aperture of a part made of a second material having no usable plastic domain, using an intermediate portion made of a third material, mounted between said member and said part, characterized in that the part is arranged to be accommodated against a first level of the intermediate portion and to be resiliently locked on a second level of the intermediate portion by driving on the member, the second level of the intermediate portion includes at least one resilient locking device including a cantilever arm of a base attached to the first level of the intermediate portion in order to secure together the unit comprising the member—intermediate portion—part.

This configuration advantageously enables the unit comprising the part-intermediate portion-member to be secured without bonding to an ordinary, precision controlled member, while ensuring that the part is not subject to destructive stresses, even if it is formed, for example, from a silicon base.

In accordance with other advantageous features of the invention:

- the arm of each resilient locking device includes a strip which is resiliently bent by the member and a portion of which cooperates with a portion of corresponding geometry formed on the inner diameter of the aperture of the part in order to secure the intermediate portion against the part;
- the portion cooperating with a portion of corresponding geometry formed on the inner diameter of the aperture of the part forms a tenon, or a mortise recess, which cooperates with a mortise recess, or a tenon, made on the inner diameter of the aperture of the part;
- the portion cooperating with a portion of corresponding geometry formed on the inner diameter of the aperture of the part is formed on the free end of each arm;

- the second level includes three resilient locking devices;
- the first level of the intermediate portion includes a peripheral shoulder for accommodating the part and at least three studs for driving the member onto the intermediate portion;
- the member has an arbour extended by a shoulder for axially locking the part and the intermediate portion against the member;
- the aperture in the part has a cross-section with a maximum width of between 0.2 mm and 2 mm;
- the aperture in the part has a circular, polygonal or asymmetrical cross-section;
- the second material is silicon-based;
- the third material is formed from a metal or metal alloy base.

Further, the invention relates to a timepiece, characterized in that it includes at least one assembly system according to any of the preceding variants, the part with no usable plastic domain being able to be, for example, a wheel, a pallet lever or a balance spring.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
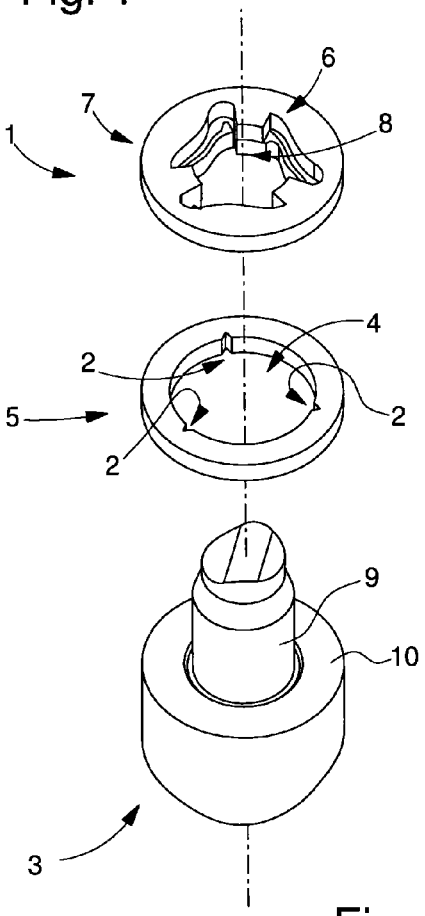
FIG. 1 is an exploded view of an assembly system according to the invention.

As explained above, the invention relates to an assembly system intended to secure a fragile material, i.e. which has no usable plastic domain (i.e. very limited plastic domain) such as a silicon-based material, to a ductile material such as a metal or metal alloy.

This assembly system was devised for applications within the field of horology. However, other domains may very well be envisaged, such as, notably aeronautics, jewelry, the automobile industry or tableware.

In the field of horology, this assembly is required due to the increasing importance of fragile materials, such as those based on silicon such as quartz, crystalline silicon, silicon nitride, silicon carbide or silicon oxide, based on corundum or more generally based on ceramics. By way of example, it is possible to envisage forming the balance spring, balance, pallets, bridges or even wheel sets, such as the escape wheels, completely or partially from a base of fragile materials.

However, always being able to use ordinary steel arbours, the fabrication of which has been mastered, is a constraint which is difficult to reconcile with the use of parts having no usable plastic domain. Indeed, when tests were carried out, it was impossible to drive in a steel arbour and this systematically broke fragile parts, i.e. those with no usable plastic domain. For example, it became clear that the shearing generated by the metallic arbour entering the aperture in a silicon component systematically breaks the component.

The invention relates to a system 1 of assembling a member 3, made of a first material in the aperture 4 of a part 5, made of a second material having no usable plastic domain, using an intermediate portion 7, made of a third material, mounted between member 3 and part 5.

According to the invention, part 5 is accommodated against a first level 6 of intermediate portion 7 and is resiliently locked on a second level 8 of intermediate portion 7 by member 3 in order to secure together the unit comprising member 3-intermediate portion 7-part 5.

Figure 2:
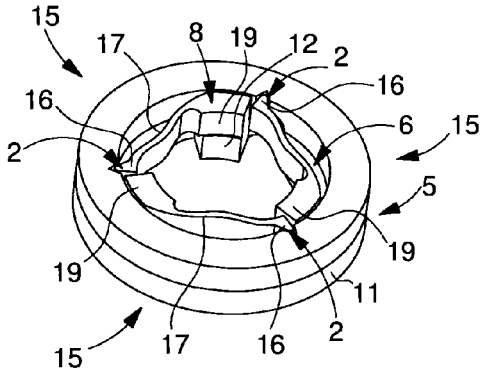
FIG. 2 is a partial perspective view of an assembled assembly system according to the invention.
Figure 3:
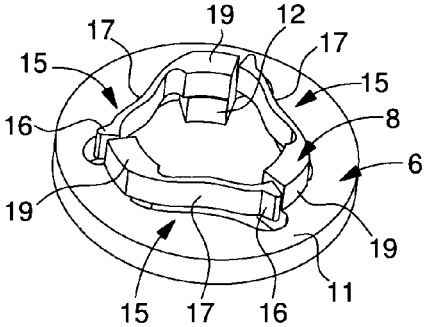
FIGS. 3 and 4 are perspective views of an intermediate portion according to the invention.
Figure 4:
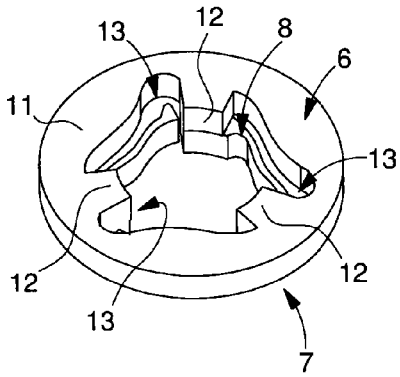
Figure 7:
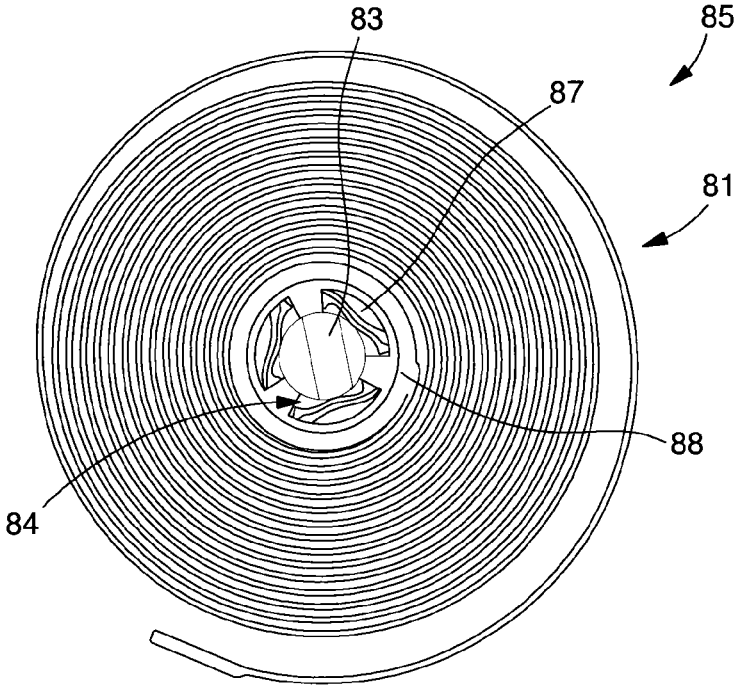
FIG. 7 is a partial schematic view of a timepiece balance spring including an assembly system according to the invention.
Figure 6:
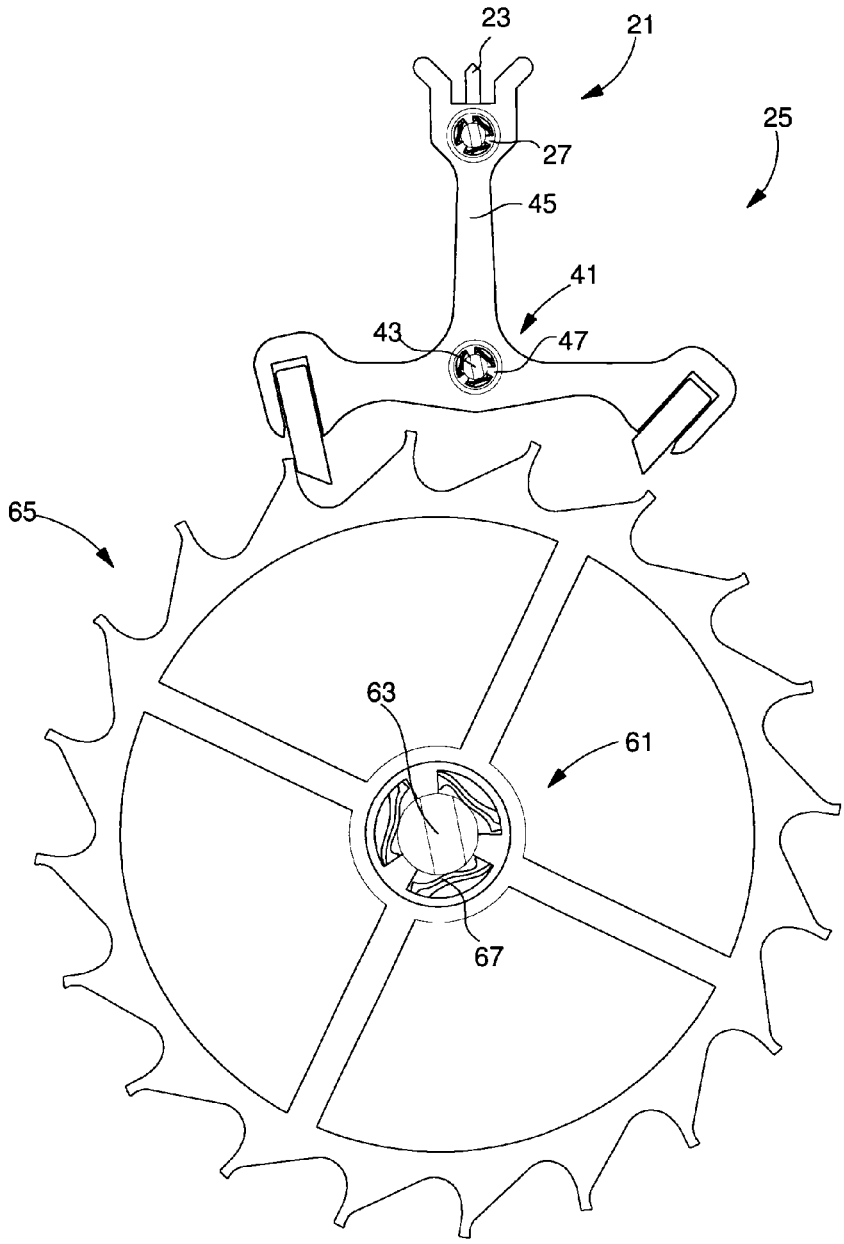
FIG. 6 is a partial, schematic view of a timepiece movement including three assembly systems according to the invention.

As illustrated in FIGS. 1 to 2, part 5 made of a second material with no usable plastic domain is shown with an annular shape. However, as illustrated in FIGS. 6 and 7, this annular shape is only one portion of part 5 intended to explain assembly system 1. As illustrated in FIGS. 1 to 2, part 5 has a substantially circular aperture 4. Aperture 4 of part 5 preferably has a cross-section with a maximum width of between 0.2 mm and 2 mm.

Further, as seen in FIGS. 1 and 2, the inner diameter of aperture 4 of part 5 preferably includes recesses 2 for securing intermediate portion 7 against part 5.

FIG. 1 shows a member 3 according to the invention. Member 3 includes an arbour 9 extended by a shoulder 10 for axially locking part 5 and intermediate portion 7 against member 3. The cross-section of arbour 9 is preferably smaller than that of aperture 4, so that part 5 can slide therein without a friction fit.

According to the invention, first level 6 of intermediate portion 7 has a peripheral shoulder 11 for accommodating at least one portion of part 5. Further, the first level 6 of intermediate portion 7 includes at least three studs 12 for driving the arbour 9 of member 3 onto the intermediate portion 7. Finally, first level 6 of intermediate portion 7 preferably includes holes 13 revealing one portion of the second level 8 of intermediate portion 7 in order, in particular, to check that assembly system 1 is properly locked.

According to the invention, second level 8 of intermediate portion 7 includes at least one resilient locking device 15 (three devices 15 are shown in the Figures) including a cantilever arm 17 of a base 19 attached to first level 6 of intermediate portion 7. Preferably according to the invention, the free section formed between bases 19 is larger than that formed between studs 12 so as to drive arbour 9 of member 3 in preference and priority against first level 6 of intermediate portion 7. Further, the first 6 and second 8 levels of intermediate portion 7 are, preferably, manufactured integrally, for example using an electroforming process.

Figure 5:
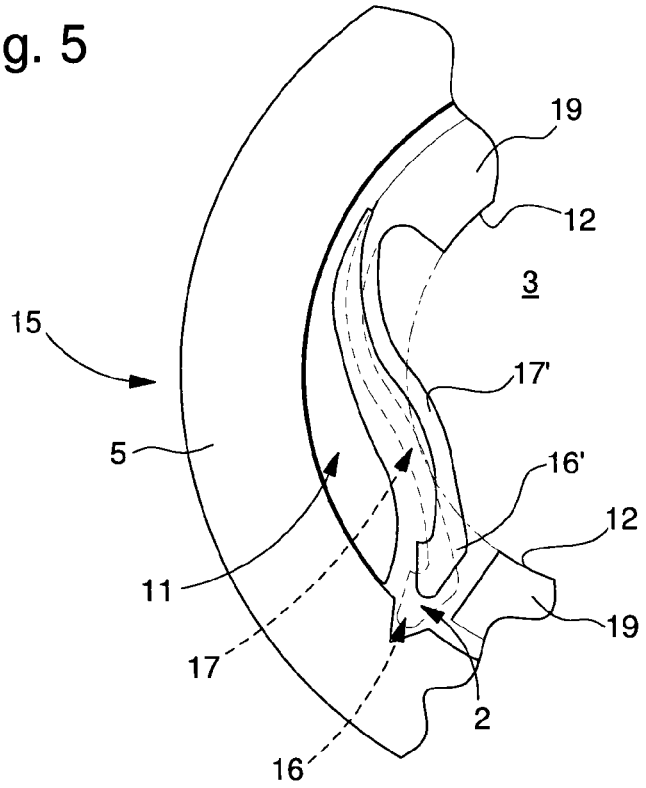
FIG. 5 is a partial view showing the locking of an assembly system according to the invention.

Preferably according to the invention, as seen more clearly in FIGS. 2 and 5, the arm 17 of each resilient locking device 15 includes a strip, which is resiliently bent by member 3 and one portion 16 of which cooperates with a portion of corresponding geometry formed on the inner diameter of aperture 4 of part 5 in order to secure intermediate portion 7 against part 5.

In the example of FIGS. 2 and 5, the portion 16 cooperating with a portion of corresponding geometry formed on the inner diameter of aperture 4 of part 5 is formed on the free end of each arm 17. Of course, portion 16 may be formed at another location on each arm 17.

In the example illustrated in FIGS. 1 and 2, portion 16 of each arm 17 forms a tenon which cooperates with one of mortise recesses 2 made on the inner diameter of aperture 4 of part 5. Of course, other shapes and/or types of joint and/or an inverted joint and/or alternate different joints may be envisaged with no loss of technical effect. By way of example, one of resilient locking devices 15 could, unlike the others, include a mortise, formed on a median portion of an arm, and which cooperates with a tenon formed on the inner diameter of the aperture of the part.

The example of FIGS. 2 to 5 illustrates more clearly how the strip of each arm 17 is bent by member 3. The dotted lines show an arm 17' and the portion 16' thereof of a resilient locking device 15 when arm 17 is not bent by member 3. It will be noted that one portion of the strip of arm 17' goes beyond the free section formed between studs 12 of first level 6 of intermediate portion 7.

It is therefore clear that, when member 3 is preferably driven against studs 12, the strip of each arm 17' is bent when member 3 passes forcing each arm 17' to move towards the inner diameter of aperture 4 of part 5. In FIG. 5 the movement of arm 17' is shown by the reference 17 in dotted lines. Likewise, the portion 16' is referenced 16 and housed inside recess 2 formed on the inner diameter of aperture 4 of part 5.

Of course, depending upon the curvature of arm 17' at rest, the movement of arm 17' resulting from bending, the position of portion 16' on arm 17' and the distance of the point of contact of member 3 on arm 17' relative to the associated base 19, it is possible to selectively adapt how far portion 16' moves closer to the inner diameter of aperture 4 of part 5. Thus, by way of example, the movement of portion 16' may be greater or smaller than the movement of arm 17' resulting from bending via contact with member 3.

Consequently, once the three resilient locking devices 15 mounted on intermediate portion 7 have been activated, member 3, intermediate portion 7 and part 5 form an integral unit.

FIGS. 6 and 7 show example applications within the field of watchmaking. In the case of FIG. 6, pallet lever 25, by way of example, includes two assembly systems 21, 41 according to the invention, respectively intended to secure the dart 23 and pivot pin 43 to the lever 45.

As seen in FIG. 6, each assembly system 21, 41 includes an intermediate portion 27,47 cooperating between dart 23 or pin 43 and lever 45 of pallet lever 25. It is thus clear that each assembly system 21, 41 is sufficiently resistant to avoid generating relative movements between its components.

The escape wheel, and more generally wheel 65 includes, by way of example, an assembly system 61 intended to secure a pivot pin 63 to wheel 65. As seen in FIG. 6, assembly system 61 includes an intermediate portion 67 cooperating between pin 63 and wheel 65.

It is thus immediately clear that the example assembly system 61 can be applied to any type of wheel set. Further, pin 63 may comprise a pinion in a single part to form a complete wheel set.

As illustrated in FIG. 7, it is possible to fix a balance spring 85 to a balance staff 83, by using an assembly system 81 of the invention. To achieve this, an intermediate portion 87 is mounted in aperture 84 of collet 88 in a similar manner to the explanations given above.

Of course, this invention is not limited to the illustrated example but is capable of various variants and alterations that will appear to those skilled in the art. In particular, aperture 4, 84 is in no way limited to a circular cross-section. Thus, other shapes can be envisaged, such as, for example, polygonal or asymmetrical shapes.

Likewise, although intermediate portion 7 is in preference and priority driven onto first level 6, second level 8 and/or both levels 6, 8 together may also be used to drive member 3 onto intermediate portion 7.

What is claimed is:

1. An assembly system comprising:

a member, made of a first material, assembled in an aperture of a part made of a second material having no plastic domain, and an intermediate portion made of a third material, mounted between said member and said part, wherein the part is arranged to be accommodated against a first level of the intermediate portion and to be resiliently locked on a second level of the intermediate portion by driving on the member, the second level of the intermediate portion including at least one resilient locking device including a cantilever arm of a base attached to the first level of the intermediate portion to secure together a unit comprising the member—intermediate portion—part.

2. The assembly system according to claim 1, wherein the arm of each resilient locking device includes a strip, which is resiliently bent by the member and one portion of which cooperates with a portion of corresponding geometry formed on the inner diameter of the aperture of the part in order to secure the intermediate portion against the part.

3. The assembly system according to claim 2, wherein the portion cooperating with a portion of corresponding geometry formed on the inner diameter of the part forms a tenon which cooperates with a mortise recess made on the inner diameter of the aperture of the part.

4. The assembly system according to claim 2, wherein the portion cooperating with a portion of corresponding geometry formed on the inner diameter of the aperture of the part forms a mortise recess which cooperates with a tenon made on the inner diameter of the aperture of the part.

5. The assembly system according to claim 2, wherein the portion cooperating with a portion of corresponding geometry formed on the inner diameter of the aperture of the part is formed on the free end of each arm.

6. The assembly system according to claim 1, wherein the second level includes three resilient locking devices.

7. The assembly system according to claim 1, wherein the first level of the intermediate portion includes a peripheral shoulder for accommodating the part and at least three studs for driving the member onto the intermediate portion.

8. The assembly system according to claim 1, wherein the member includes an arbour extended by a shoulder for axially locking the part and the intermediate portion against the member.

9. The assembly system according to claim 1, wherein the aperture in the part has a cross-section with a maximum width of between 0.2 mm and 2 mm.

10. The assembly system according to claim 1, wherein the aperture in the part has a circular cross-section.

11. The assembly system according to claim 1, wherein the aperture in the part has a polygonal or asymmetrical cross-section.

12. The assembly system according to claim 1, wherein the second material is silicon-based.

13. The assembly system according to claim 1, wherein the third material is formed from a metal or metal alloy base.

14. A timepiece wherein it includes at least one assembly system according to claim 1.

15. The timepiece according to claim 14, wherein the part with no usable plastic domain is a wheel, a pallet lever or a balance spring.

* * * * *